United States Patent [19]

Breeze et al.

[11] Patent Number: 4,837,480

[45] Date of Patent: Jun. 6, 1989

[54] SIMPLIFIED PROCESS FOR FABRICATING DISPENSER CATHODES

[75] Inventors: Glenn S. Breeze, Carson; Robert M. Baird, Redondo Beach, both of Calif.

[73] Assignee: Hughes Aircraft Company, Los Angeles, Calif.

[21] Appl. No.: 174,262

[22] Filed: Mar. 28, 1988

[51] Int. Cl.[4] ..... H01J 7/18; H01J 7/385

[52] U.S. Cl. ..... 313/346 DC; 445/31

[58] Field of Search ..... 313/346 DC, 346 R; 445/31, 55, 73, 70; 252/181.2, 181.6

[56] References Cited

U.S. PATENT DOCUMENTS 2,902,620 9/1959 Winter ..... 313/346 DC 4,518,890 5/1985 Taguchi et al. ..... 313/346 DC X

*Primary Examiner*—Kenneth Wieder

*Attorney, Agent, or Firm*—Terje Gudmestad; A. W. Karambelas

[57] ABSTRACT

A dispenser cathode and method for making the same are disclosed wherein a mixture of tungsten and aluminate powders are pressed by a die into a foil sleeve. A heater assembly can be attached to the back of the pellet for activating the emissive material. An impregnated cathode therefore can be manufactured in a few hours by relatively inexpensive processing techniques.

12 Claims, 2 Drawing Sheets

SIMPLIFIED PROCESS FOR FABRICATING DISPENSER CATHODES

BACKGROUND OF THE INVENTION

1. Field of the Invention

The invention relates generally to thermionic emission cathodes and more particularly to an expendable dispenser cathode and method for making the same.

2. Description of Related Art

A dispenser cathode serves as the primary source of electrons for microwave tubes or cathode ray tubes (CRT). Electrons provided by a dispenser cathode are accelerated to form an electron beam. Typically, dispenser cathodes include a refractory metal body such as tungsten or molybdenum which is porous. A electron emitting material such as a barium-calcium aluminate is impregnated into the pores of the porous metal body. When the cathode is heated, emissive material migrates through the pores to the emission surface. The dispenser cathode emits electrons as long as there is emitting material left in the body.

There are several methods known in the art to manufacture dispenser cathodes. In a typical example the manufacturing process may include pressing tungsten powder into a billet and sintering the billet in a furnace to diffuse the particles together. Copper is melted into the billet, in a high temperature furnace, to hold the billet together and aid machining. Thereafter, the billet is placed in a lathe and machined to the desired size forming a pellet. The sized pellet is cleaned and the copper removed therefrom by evaporation in a high temperature vacuum furnace. The pellet is then brazed into a metallic cathode sleeve. Thereafter, the pellet is impregnated with an aluminate mixture which is melted into the pores of a pellet in a high temperature furnace. Next, the emitting surface of the pellet may be sputter coated with osmium/ruthenium. In the end, a highly reliable dispenser cathode results. However, the process for manufacturing this cathode involves highly time-consuming, labor intensive steps, including several machining steps, several high temperature processing steps, brazing and sintering. Manufacturing a batch of ten such cathodes can easily take more than a week. In many applications, high reliability dispenser cathodes are needed, such as in space. However, in other applications such as radar systems for aircraft and missiles and cathode ray tubes for televisions or oscilloscopes, for example, the method steps involved in manufacturing such high reliability dispenser cathodes undesirably and unnecessarily increase the expense of the finished product.

Accordingly, a much simpler and cost effective method of manufacturing a dispenser cathode is needed.

SUMMARY OF THE INVENTION

It is therefore an object of the invention to provide a simpler and less expensive method for manufacturing a dispenser cathode than is available in the prior art.

It is a feature of the present invention to press a mixture of refractory metal powder and emissive material powder together into a metallic support structure thereby forming a basic dispenser cathode assembly in a simple single step.

It is an advantage of the present invention that more cathodes can be manufactured in very short periods of time.

A dispenser cathode according to the present invention includes a metal support member which forms the sleeve for a dispenser cathode. A powdered mixture of electron emissive material and refractory metal material is pressed together into the metal support member forming an impregnated cathode pellet. A heater element is securely attached to the back of the pellet to activate the emissive material.

Other and further objects, advantages and characteristic features of the present invention will become readily apparent from the following detailed description of a preferred embodiment of the invention when taken in conjunction with the appended claims.

DETAILED DESCRIPTION OF THE INVENTION

Figure 1A:
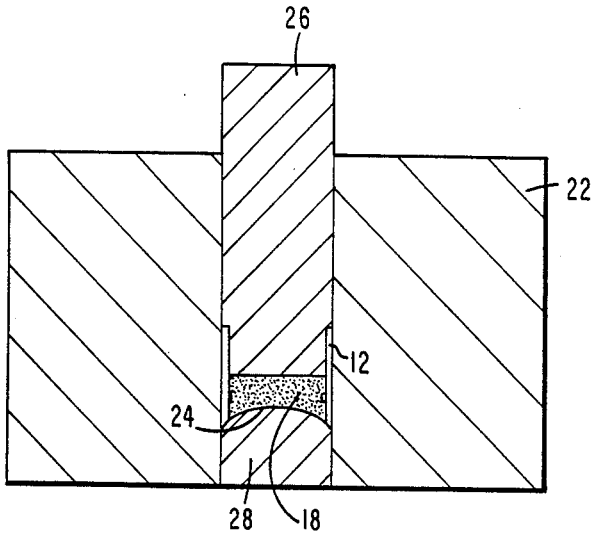
FIGS. 1*a* and 1*b* are cross-sections of a portion of a dispenser cathode fabricated according to the invention.
Figure 1B:
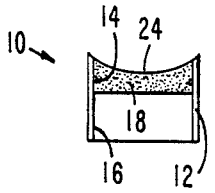
Figure 2:
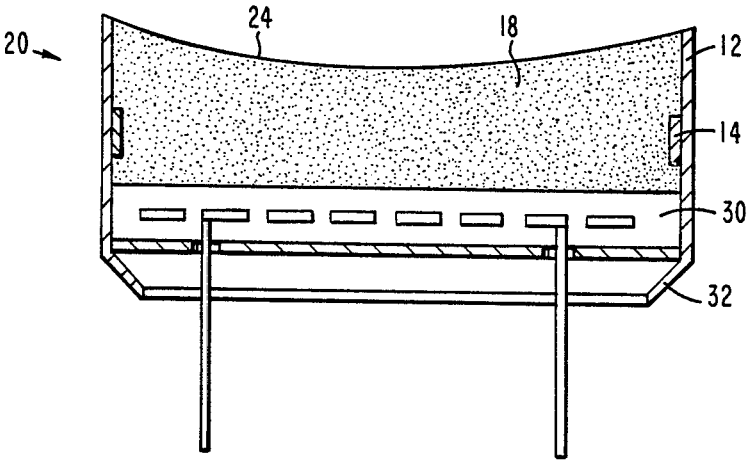
FIG. 2 is a cross-sectional view of a complete dispenser cathode.

Referring now with greater particularity to FIGS. 1 and 2, a preferred method for fabricating a dispenser cathode 20 begins with a cylindrical tube 12 made of molybdenum, moly-rhenium, tungsten or nickel about 1 mil thick, which serves as the support member for the dispenser cathode. A retainer 14 ring made of moly-rhenium may be spot welded to the annular inner surface 16 of the cylindrical tube 12 forming a means for holding the impregnated cathode pellet 18 (formed subsequently) in the support member. Alternatively, for example, an inner annular groove may be formed in the wall of the cylindrical tube by swaging or drawing.

Aluminum oxide powder, barium carbonate powder and calcium carbonate powder are randomly mixed together in a jar by rolling, for example, yielding an aluminate powder mixture of emissive material. This mixture which may be made in bulk is heated to a high temperature of 1365° C., for example, to convert the emissive material to an oxide. The aluminate powder mixture is in turn mixed with particles of pure tungsten, or other refractory metal. The activating material mixture has been found useful in a mixture of 20 percent by weight barium calcium aluminate having a 5:3:2 mole ratio, respectively, and 80 percent by weight tungsten powder. Of course, other barium-bearing compounds that will decompose when heated to supply activating material to the emitter surface of the emitter dispenser can be used.

The support member and the mixture of aluminate and tungsten powder are inserted into a pressing die 22 as shown in FIG. 1*a*. Longitudinal pressure is applied by die press members 26 and 28 to press the powder mixture into the cylindrical tube of the support member, thereby forming pellet 18. An impregnated cathode is formed in its support member in one single and simple step. The pellet 18 typically has a concave front surface 24 which is the emitting surface of the cathode. The pressing procedure may be performed either cold or hot with a hot press being preferred to achieve the desired density. Typically for a hot press a pressure of about 40–60 KPSI may be employed and for a cold press a pressure of about 100–150 KPSI may be employed to form the pellet 18 shown in FIG. 1*b*.

A heater assembly 30 is securely attached to the back surface of cathode pellet 18 by bonding the heater to the pellet or crimping the end 32 of the cylindrical tube over heater assembly 30 as shown in FIG. 2. The heater assembly 30 may be a photo-etched heater encapsulated in a thermally conductive material such as aluminum oxide ($AL_2O_3$), for example. Alternatively, a helical wire filament "potted"in an electrical insulating material such as alumina ceramic may be used, for example. Accordingly, heat from the heater assembly 30 is conducted to the activating material in the cathode pellet 18 thereby causing this material to migrate to the cathode emitter surface 24 and continuously replenish the activating material on the surface as it is used up during electron emission.

A coating is deposited on the emissive front surface 24 of cathode pellet 18. The coating may comprise a fully alloy combination of osmium and tungsten having proportions of about 80–70 percent osmium/ruthenium and 20–30 percent tungsten, for example. Other proportions, of course, may be employed. The coating is formed by co-sputtering osmium/ruthenium or osmium and tungsten onto the pellet front surface 24. The coating may also be formed by co-evaporating or co-precipitating the metals onto the cathode pellet front surface. The coating may have a thickness in the range of about 2000 to 15,000 Å, thickness of about 10,000 Åbeing used in this example.

Figure 3:
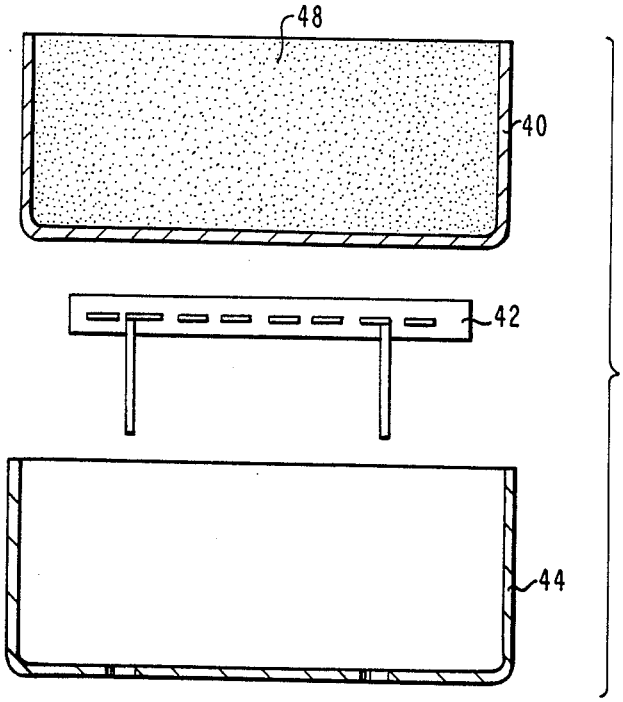
FIG. 3 is an exploded view of a dispenser cathode fabricated by another preferred method.
Figure 4:
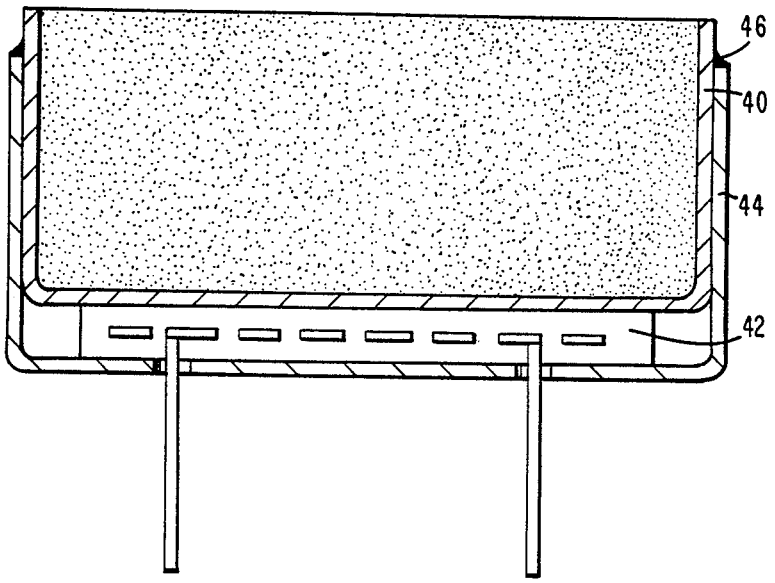
FIG. 4 is a section view of a complete dispenser cathode of FIG. 3.

In an alternative embodiment illustrated in FIGS. 3 and 4, the powder mixture is pressed into a cup-shaped member 40 forming an impregnated cathode pellet 48 therein. The cup-shaped member 40 may be made of moly-rhenium foil about 5 mils thick, for example. Cup-shaped member 40 may be easily manufactured by deep drawing over a mandrel or swaging techniques, well-known in the art. Heater assembly 42 is placed under cup-shaped member 40, and both cup 40 and heater 42 are inserted into a second cup-shaped member 44 as shown in FIG. 4. Cup-shaped members 40 and 44, and heater assembly 42 sandwiched therebetween are held in tight relationship while second cup-shaped member 44 is securely attached to cup-shaped member 40 by welding or brazing 46, for example. Second cup-shaped member may also be made of moly-rhenium foil about 5 mils thick, for example.

Impregnated cathodes can therefore be manufactured involving no machining, no high temperature furnace processing and no sintering, as required in prior art structures, but only simplified manufacturing processes allowing fabrication of dispenser cathodes in bulk quantities at low cost.

Various modifications may be made to the above-described embodiments without departing from the scope of the invention. For example, the shape of the cathode pellet and its support member may be shaped differently. Thus, although the present invention has been shown and described with reference to particular embodiments, nevertheless, various modifications and changes obvious to one skilled in the art are deemed to be within the spirit, scope and contemplation of the invention, as set forth in the appended claims.

What is claimed is:

1. A method for manufacturing a dispenser cathode comprising:

providing a mixture of electron emissive material powder and refractory metal power;

providing a metallic support member; and pressing said mixture together and into said metallic support member forming therein a pellet of impregnated cathode material having an emissive surface.

2. The method defined in claim 1 further comprising the step of forming a retaining means in the metallic support member.

3. The method defined in claim 2 further comprising the steps of providing a heating element; and attaching said heating element adjacent to said pellet for heating said pellet and activating said electron emissive material.

4. The method defined in claim 3 further comprising the steps of:

coating said emissive surface with osmium and ruthenium.

5. The method defined in claim 4 wherein said electron emissive material powder is aluminate powder and said refractory material powder is tungsten powder.

6. A method for fabricating a dispenser cathode comprising the steps of:

forming a cylindrically-shaped foil sleeve with a retaining means therein;

providing a mixture of tungsten and aluminate powder;

placing the sleeve and powdered mixture into a die; and pressing the mixture into the sleeve such that a compressed pellet is formed within the sleeve having a front emissive surface and a back surface.

7. The method as defined in claim 6 further comprising the steps of:

providing a heating element; and attaching said heating element to the back surface of the pellet for heating the pellet.

8. The method as defined in claim 7 further comprising the steps of:

coating said front emissive surface with osmium/ruthenium.

9. A method for fabricating a dispenser cathode comprising the steps of:

providing a first cup;

providing a mixture of aluminate powder and tungsten powder;

pressing the mixture into said first cup forming a pellet having a front emissive surface;

providing a heating element;

providing a second cup;

inserting the heating element into said second cup followed by the first cup; and attaching said second cup to said first cup.

10. The method defined in claim 9 further comprising the step of coating the front emissive surface of the pellet with osium/ruthenium.

11. The method defined in claim 1 wherein said pressing step includes a cold press performed at about 100 to 150 KPSI.

12. The method defined in claim 1 wherein said pressing step includes a hot press performed at about 40 to 60 KPSI.

* * * * *